United States Patent [19]

Dawson

[11] 4,274,357

[45] Jun. 23, 1981

[54] POWER OPERATED SURFBOARD

[75] Inventor: Edward S. Dawson, St. Paul, Minn.

[73] Assignee: Surf-Jet Corporation, St. Paul, Minn.

[21] Appl. No.: 97,412

[22] Filed: Nov. 26, 1979

[51] Int. Cl.[3] ..... B63B 35/72; B63H 11/02

[52] U.S. Cl. ..... 114/270; 440/89

[58] Field of Search ..... 114/270; 440/38, 39, 440/41, 46, 87–89

[56] References Cited

U.S. PATENT DOCUMENTS

| | | | |
|---|---|---|---|
| 3,224,408 | 12/1965 | Stredda | 440/41 |
| 3,262,413 | 7/1966 | Douglas et al. | 440/87 X |
| 3,324,822 | 6/1967 | Carter | 440/38 |
| 3,463,116 | 8/1969 | Dawson | 440/39 |
| 3,826,220 | 7/1974 | Jacobson | 114/270 |
| 3,889,623 | 6/1975 | Arnold | 440/39 |
| 3,948,206 | 4/1976 | Tyler | 114/270 |

*Primary Examiner*—Johnny D. Cherry

*Attorney, Agent, or Firm*—Kinney, Lange, Braddock, Westman & Fairbairn

[57] ABSTRACT

A power operated surfboard which has a raised rear hollow portion at the rear in which is disposed an impeller housing having an impeller therein and a water discharge passage extending rearwardly from the housing. An internal combustion engine is supported above the impeller housing and has a short vertical axis connected to the impeller which rotates about a vertical axis. Surrounding the impeller housing is an exhaust gas housing which communicates with the exhaust gas passage of the engine and with a discharge chamber beneath the floor of the surfboard. The exhaust gas housing is gas tight and provides a gas cushion which retards the entrance of water through the discharge chamber into the exhaust passage of the engine, when the surfboard is not being operated. This is aided by a flexible valve disposed at the discharge outlet of the discharge chamber to retard the entrance of water into the discharge chamber. Associated with the exhaust gas discharge chamber and forming a part of a two chamber is a water inlet chamber which communicates with the intake of the impeller through the floor of the boat and extends over the opening to the impeller to prevent accidental contact with the rotating impeller either by an occupant or by some foreign object.

A belly pan has a bottom wall disposed between the engine and the impeller housing and surrounds the engine to form an engine compartment. Disposed at the bottom of the engine compartment is a one way valve which permits draining of water or fuel from the belly pan but hinders the access of water into the interior of the belly pan.

12 Claims, 7 Drawing Figures

POWER OPERATED SURFBOARD

BACKGROUND OF THE INVENTION

The present invention relates to a power operated surfboard and particularly to such a surfboard which may be used in a manner similar to a typical surfboard but with the advantage of having continuous power operation of the surfboard. In designing a powered surfboard, there are certain problems peculiar to a surfboard which are not present in connection with other watercraft construction. For one thing, the surfboard must be basically flat over the major portion of the upper surface to enable an operator to either stand or sit on the surfboard. The engine compartment must accordingly be relatively small and compact and at a position where it interferes as little as possible with the relatively flat upper surface desired for such a surfboard. Furthermore, it is imperative that the surfboard be as free of engine vibration as possible so as to enable the operator to manipulate the surfboard readily. In addition, it is highly desirable that the surfboard be relatively quiet since the operator is standing upon the surfboard and will be more disturbed by noise than an occupant of a boat. Moreover, it is highly desirable that water be kept out of the exhaust system of the engine as much as possible.

Motorized surfboards have previously been proposed. One such motorized surfboard is that shown in the Carter U.S. Pat. No. 3,324,822. This patent has the advantage that it provides for jet propulsion, thereby eliminating the need for a propeller which might cause injury to the operator or to someone in the water. The Carter patent, however, has a number of disadvantages including the fact that the drive shaft between the engine and the impeller is relatively long and horizontally disposed. This tends to make the surfboard relatively bulky in cross section throughout much of its length. Furthermore, the presence of such a long drive shaft will increase the tendency to vibration.

The Dawson U.S. Pat. No. 3,463,116 overcomes the disadvantage of a long drive shaft by placing the impeller and the engine both at the rear of the surfboard. While the Dawson arrangement was a marked advance over some of the prior surfboards, it has certain disadvantages. In the first place, the engine rests upon an auxiliary molded floor located above the floor of the surfboard and the impeller is located beneath this floor. In addition, there is no effective means in the Dawson arrangement to prevent the entrance of water into the exhaust system while the board is standing still. Furthermore, Dawson shows no particular means for ensuring a relatively quiet operation of the surfboard. It is very important with such a power operated surfboard to minimize the noise as much as possible.

SUMMARY OF THE PRESENT INVENTION

The present invention is concerned with a power operated surfboard of the general type shown in the Dawson patent described above in which there is an exhaust gas chamber surrounding the impeller housing and which acts as a gas cushion to prevent the entrance of water through the exhaust gas outlet into the exhaust passage of the engine.

A further feature of the invention is the provision of an exhaust gas chamber beneath the boat through which the exhaust gas is discharged. This means that the exhaust gas is discharged beneath the boat in the water, thus minimizing the noise.

Preferably, the exhaust gas chamber has a valve associated therewith which is biased to closed position and retards the entrance of water into the exhaust gas chamber beneath the boat while the boat is standing still. This valve may take the form of a member of flexible plastic which has a downturned lip extending across the open end of the exhaust chamber and biased into engagement with it. As soon as the engine is operated, this lip is forced away by reason of the pressure of the exhaust gas and pressure of the water due to forward motion of the surfboard.

The exhaust gas chamber beneath the surfboard can be part of a two compartment chamber with a partition wall therebetween, the other compartment of which has a forwardly facing opening and which overlies the inlet of the impeller. This other chamber with its forwardly facing opening directs water into the intake of the impeller and, at the same time, extends over the opening to the impeller to prevent accidental engagement with the impeller.

The exhaust gas housing surrounding the impeller housing is supported on the floor of the surfboard and in turn supports the engine, thus making unnecessary the molding of a false floor in the surfboard body.

A belly pan preferably surrounds the engine and has a bottom disposed between the engine and the exhaust gas housing. This belly pan preferably has a one-way valve disposed in its bottom to permit draining of water and any spilled fuel from the belly pan while, at the same time, preventing the admission of water into the belly pan.

Further features of the present invention will be apparent from a consideration of the accompanying specification, claims and drawings.

DESCRIPTION OF THE PREFERRED EMBODIMENT

Figure 1:
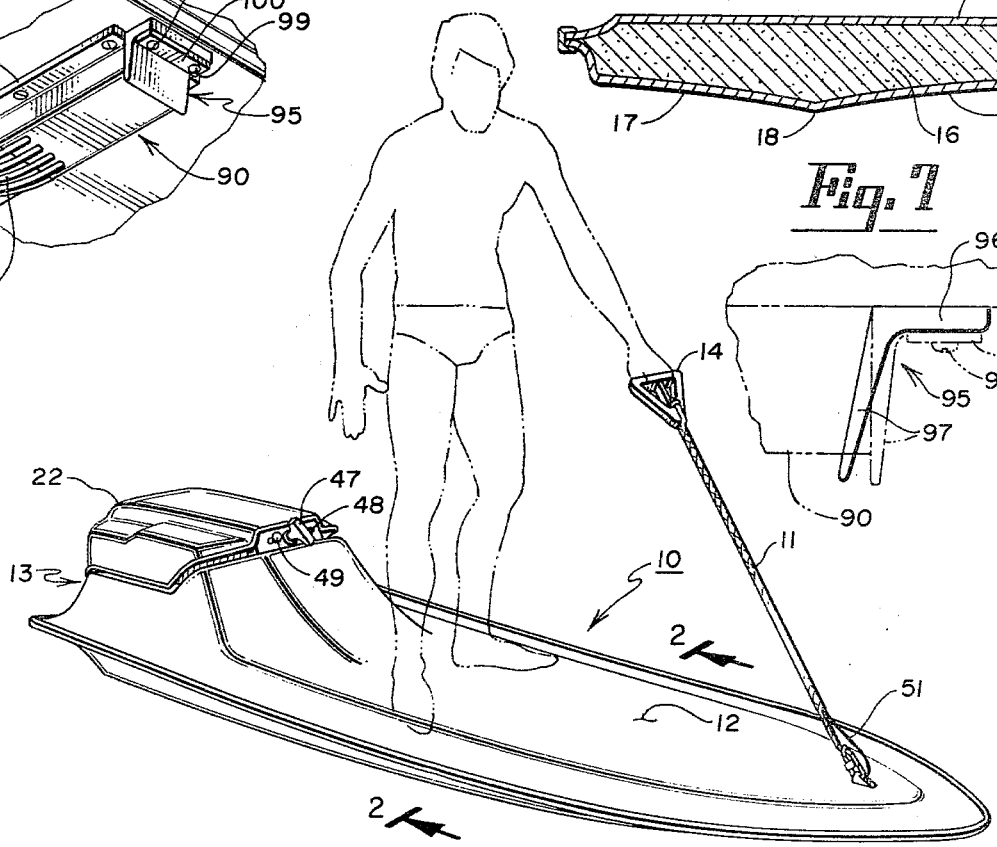
FIG. 1 is a pictorial view illustrating the manner in which the surfboard is used.

Referring first to FIG. 1, the power operated surfboard of the present invention is shown being used by an operator standing on the surfboard, which is generally indicated by the reference numeral 10. The operator is shown as holding a cable 11 which not only helps support the operator but also contains a control handle 14 to control the throttle. The control handle may include a control member for controlling the throttle through a suitable hydraulic system. Such a control is common and is hence not shown in the present application. The surfboard is shown as comprising a main portion having a generally flat upper surface 12 and a relatively short raised rear portion 13 in which is housed the engine, the impeller and the various equipment associated therewith. The body of the surfboard, as shown in cross section in FIG. 2, is formed of a shell 15, preferably of fiberglass, the shell being filled with a waterproof relatively light material 16 such as foamed polyurethane.

Figure 2:
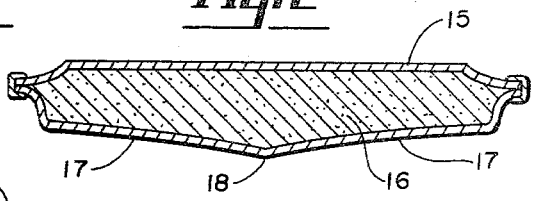
FIG. 2 is a section taken along the line 2—2 of FIG. 1.

As will be evident from FIG. 2, the bottom of the shell 15 has two concave portions 17 terminating at a center keel 18.

Figure 3:
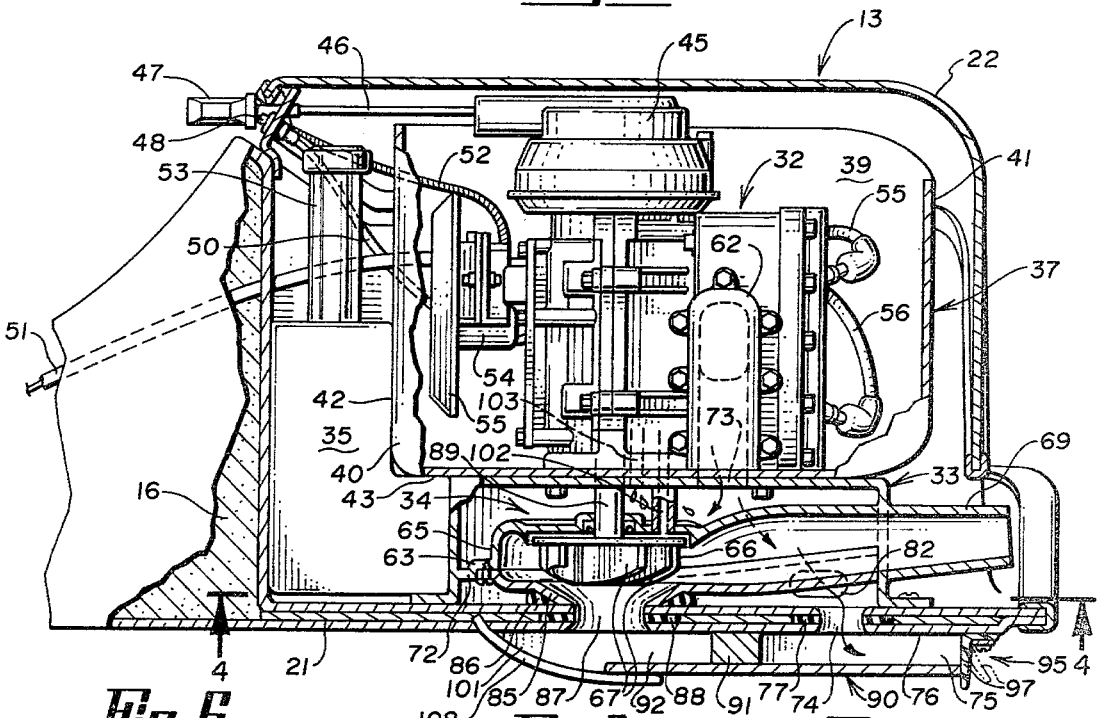
FIG. 3 is an elevational view of the interior of the rear interior hollow portion of the surfboard with portions in section.
Figure 5:
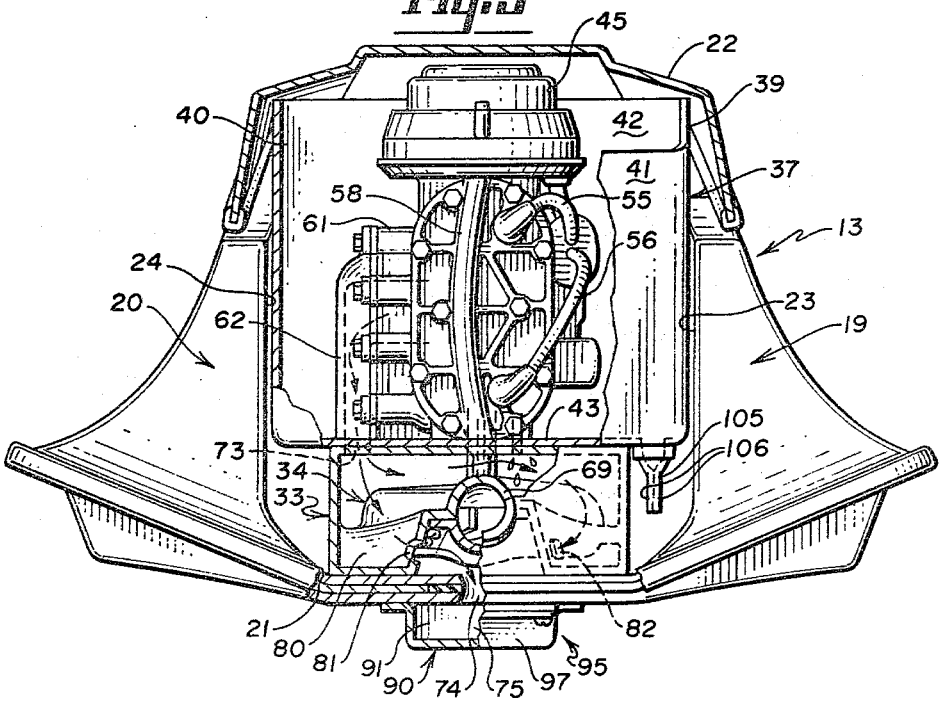
FIG. 5 is a rear elevational view with portions cut away and shown in section.

Referring now to FIGS. 3 and 5, the rear portion 13 is shown in more detail. As previously explained, it is this portion that houses the engine, the impeller and the associated equipment. As best shown in FIG. 5, the rear portion 13 has two side walls 19 and 20, a bottom wall 21, and a cover 22. The two side walls 19 and 20 are hollow and filled with polyurethane foam. They have inner walls 23 and 24 which extend vertically and are spaced from the outer surfaces of the walls 19 and 20. The cover 22 is spaced from the upper edges of the side walls 19 and 20. Any suitable means may be employed for retaining the cover 22 in position.

The inner side walls 23 and 24 together with the floor 21 form a hollow portion which is normally covered by the cover 22. This hollow portion houses the engine 32, an exhaust gas housing 33, an impeller housing 34 and a fuel tank 35. The engine 32 is enclosed by a belly pan 37 having side walls 39 and 40, a rear wall 41 and a front wall 42. The belly pan 37 has a bottom wall 43 which is disposed beneath the engine as best shown in FIGS. 3 and 5. The belly pan forms an engine compartment and prevents water from being splashed onto the engine so as to impair the operation of the ignition.

The engine 32 is a conventional internal combustion engine which is shown as a two cylinder engine. The engine has a retractable hand operated starting mechanism 45 with a starting cable 46 secured to a handle 47 extending forwardly and which can be pulled out to start the engine. This arrangement is a conventional arrangement and need not be described in any more detail. The engine is also provided with an ignition switch 48 connected through a cable 50 to the ignition system of the engine. The device also has a choke control 49 connected through a cable 52 to the choke of the engine. The throttle control in handle 14 is connected through a cable 51 to a hydraulic control for the throttle of the engine. The cable extends through the interior of the surfboard body and out through the area at which the cable is attached, as shown in FIG. 1. Such a hydraulic control is common and does not form part of the present invention. The engine is provided with the usual carburetor 54 having an air intake through an air cleaner 55.

The engine is also provided with the usual spark plugs and ignition cables 55 and 56 leading to the spark plugs. Extending across the manifold cover is a conduit 58 for conveying cooling water to a portion of the engine. The engine is provided with an exhaust manifold 61 having a conduit portion 62. The engine is provided with a vertical output shaft (not shown) which is connected to the shaft of the impeller, which will be presently described.

Referring now to the exhaust gas housing 33, this housing rests upon and is secured to the floor 21 of the hollow compartment of the surfboard body. The gas-tight housing 33 is preferably secured to the floor 21 by any suitable fastening means. The belly pan 37 rests upon and is secured to the housing 33. The housing 33 thus supports the engine, eliminating the need for a molded false floor as in the Dawson U.S. Pat. No. 3,463,116.

Figure 4:
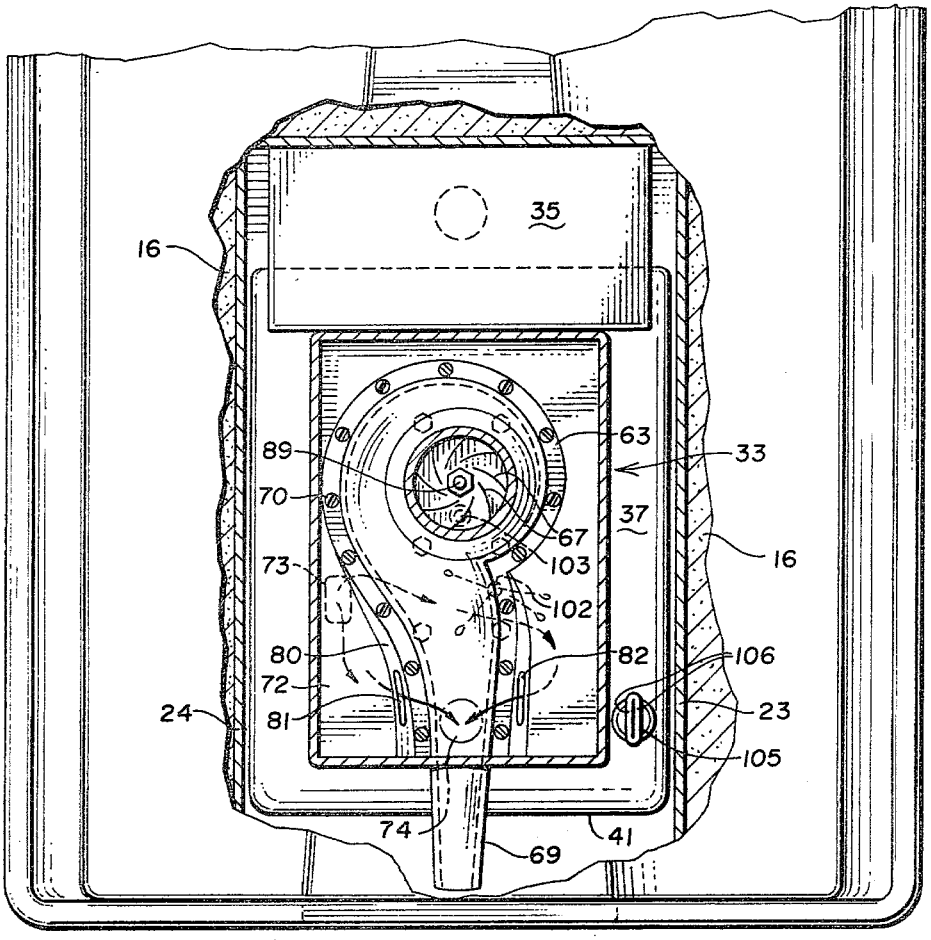
FIG. 4 is a sectional view taken along the line 4—4 of FIG. 3, looking upwardly in the direction of the arrows to show the impeller pump, the fuel tank and the bottom of the belly pan.

The exhaust gas chamber 33 is secured in a gas-tight manner to the impeller housing 34. Referring to the impeller housing, this is best shown in FIGS. 3, 4 and 5. It will be noted that it has a central portion 65 in which is housed the impeller 66. The impeller 66 is a centrifugal impeller having a plurality of vanes 67 which, upon rotation of the incoming water, throws it outwardly through a discharge nozzle 69 extending through the rear of the housing of the surfboard, slightly above the floor thereabove.

The impeller housing 34 has a flange 63 extending completely around the periphery of the housing 34 up to the point where it extends through the rear wall of housing 33. This flange is best shown in FIG. 4. The flange is secured in a gastight manner, by bolts 70 or other suitable fastening means such as cap screws, to a flange 72 extending inwardly from the housing 33 and integral with the housing. The flanges 63 and 72 collectively form a partition, separating the upper portion of housing 33 from the lower portion.

The upper portion of the exhaust housing 33 has an opening 73 which communicates with the discharge opening of the exhaust manifold 62. Thus, the exhaust gas leaving the exhaust manifold 61 and passing through the conduit portion 62 enters the area above the impeller housing 34. The area of the exhaust gas housing 33 below the flanges 63 and 72 and below the impeller housing 34 communicates through a passage 74 with the interior of an exhaust gas discharge chamber 75 which will be described presently. The opening 74 not only extends through the floor 21 of the hollow compartment but also through the lowermost floor 76 of the hollow compartment, there being a slight space between the floor of the hollow compartment 22 and the actual lower floor 76 of the surfboard which is filled with a rigid water resistant plastic material. A suitable gasket 77 is disposed between the floors 21 and 76 surrounding the opening 74 to prevent the escape of gas between the two floors.

The rear portion of the flange 63 of impeller housing 34 is flared outwardly towards the rear as best shown in FIG. 5. This portion is designated by the reference numeral 80. It will be noted that this portion extends downwardly to the floor 21 of the hollow portion. In order to permit the exhaust gas entering the upper portion of exhaust gas chamber 33 to pass through the area beneath the wall of widened portion 80 and thus to enter the opening 74 into the exhaust gas discharge chamber 75, two apertures 81 and 82 are provided through the wall of the widened portion 80 of flange 63 of the impeller housing. These openings 81 and 82 permit gas to pass beneath the partition formed by the flanges 63 and 72 and through the opening 74.

Referring back to the intake to the impeller housing 34, this has a neck portion 85 which engages the floor 21 with a gasket 86 clamped therebetween. The gasket 86 is to prevent the escape of any water into the exhaust chamber. A passage 87 extends through the two floors 21 and 76 and communicates with the intake of the impeller 66. A gasket 88 is disposed between floors 21 and 75 adjacent the passage 87. The passage 87 thus constitutes the intake passage of the impeller.

The impeller has a vertical shaft 89 which is connected by means (not shown) to the vertical output shaft of the engine. Because the vertical shafts of the impeller and engine are very short and because the engine and impeller housing are both securely fastened to exhaust gas housing 33, there is a minimum of vibration.

Figure 6:
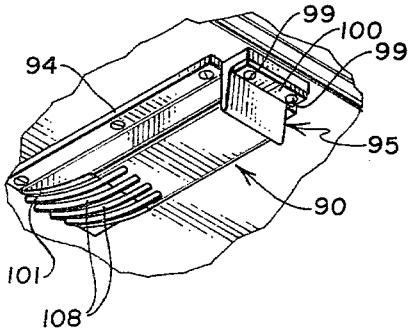
FIG. 6 is a perspective view of the housing secured to the underside of the floor of the surfboard for directing the intake of the water and the discharge of the exhaust gas.

The exhaust gas discharge chamber 75 forms part of a housing 90 resembling a skeg. This housing 90 is divided into two compartments by a partition 91 (as best shown in FIG. 3) which divides the housing 90 into the gas discharge chamber 75 and a fluid intake chamber 92. The housing 90 has two side flanges 94, only one of which is shown in the drawing and which appears in FIG. 6. These flanges are employed to mount the housing 90 to the underside of the surfboard.

Figure 7:
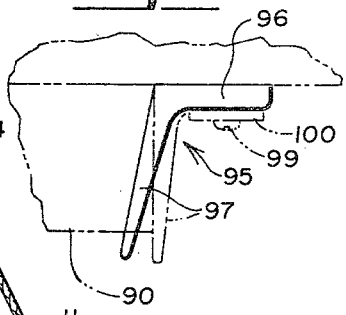
FIG. 7 is a fragmentary view of the valve associated with the housing of FIG. 6.

Referring to the exhaust gas discharge chamber 75, it will be noted that the rear end of this chamber is open. Associated with the chamber, however, is a valve member generally designated by the reference numeral 95. This valve member is formed of a flexible resilient synthetic plastic material and has a horizontal flange 96 and a downwardly extending lip 97. As best shown in FIG. 7, the lip 97 tends to be biased inwardly away from a line vertical to the axis of the flange 96. In mounting the same, the valve member 95 is secured to the underside of the surfboard by a plurality of screws 99. Preferably a washer strip 100 is interposed between the screws and the flange 96. The flange is mounted in such a position that, as shown in dotted lines in FIG. 7, the lip 97 is deflected backwardly so that it abuts the open end of the housing 90, thus tending to prevent any water from entering the exhaust gas chamber 75. When, however, the engine is running so that exhaust gas pressure builds up within the exhaust gas housing 33 and hence in the exhaust gas discharge chamber 75, the lip 97 is deflected in a counterclockwise direction as shown in dotted lines in FIG. 3 to permit the escape of exhaust gas.

This lip 97 extends downwardly slightly below the bottom of housing 90. This extension of the lip 97 is engaged by the water as the surfboard moves forwardly to further aid in moving the lip 97 away from the end of the housing 90. In other words, the resiliency of the valve member 95 is such that while the lip member 97 is normally held in engagement with the end of the exhaust gas discharge chamber 75, the lip member 97 can still readily be deflected to an open position by the gas pressure and by the forward motion of the surfboard.

Referring now to the fluid intake chamber 92, this is open at its front end and has a curved front wall 101. Curved bars 108 preferably extend longitudinally over the opening 101. Water is thus scooped up by the fluid intake chamber 92 and is directed upwardly through the opening 87 into the impeller 66. A very important function of the water intake chamber 92 is that it acts as a guard around the opening 87. If it were not for this, it would be possible for a foreign object to come into contact with the impeller. If it were the limb of a human being, this could cause severe injury to the human. On the other hand, if it were a hard foreign object, it could easily damage the impeller 66. By providing the water intake chamber 92 and the curved bars 108 across the opening, it would be difficult for a foreign object to directly enter through the opening 87. It would be almost impossible for an operator to insert his hand through the bars into the impeller.

Referring back to the gasoline tank 35, it will be noted that this is L-shaped in transverse cross-section, the major portion extending vertically between the front wall of the hollow compartment and the front wall 42 of the belly pan with a shorter horizontal portion extending beneath the lower wall 43 of the belly pan. The gasoline tank is provided with a filler pipe 53 extending upwardly to an area readily accessible when the cover 22 is removed.

In order to cool the engine, a certain amount of the water is bled off from the top of the impeller 66 through a conduit 102 which leads into the cooling jacket of the engine. The engine is also provided with a return conduit for this cooling water which is shown in dotted lines and designated by the reference numeral 103. This return conduit opens into the exhaust gas housing 33 so that the cooling water is discharged into the exhaust gas and is carried out through the exhaust gas discharge chamber 75. The water passing in this manner into the exhaust gas tends to cool the exhaust gas somewhat.

The belly pan 37 has a drain valve 105 secured to the bottom wall 43 thereof. The function of the drain valve is to permit water and any spilled fuel accumulating in the belly pan 37 to escape. At the same time, the drain valve 105, having two lips 106 which are biased together, prevents the entrance of any water. The drain valve 105 is preferably molded of a suitable resilient material. Because of this, any water or spilled fuel that accumulates in the belly pan 37 during operation tends to be directed below and can be carried out through the rear of the surfboard.

OPERATION

When the operator desires to operate the surfboard, the ignition is turned on by actuation of the ignition button 48. The choke can be closed by pulling out the handle 49. The operator then pulls on the handle 47 in the usual manner to start an engine of this type. This can all be done while the operator is standing on the surfboard. The engine will presumably be placed into operation after one or more pulls of the handle 47. Thereafter, the choke can be opened and the surfboard is ready for use. The water will enter the fluid intake chamber 92 and be forced by the impeller 66 out through the discharge nozzle 69. This will cause the surfboard to move forward. The operator by manipulating the control in the handle 14 can through the cable 51 and a hydraulic control actuate the throttle of the engine. The operator is thus able to conveniently manipulate the speed. At this time, the operator is in the position shown in FIG. 1. As the throttle operator in the handle 14 is depressed, the speed can be increased.

As soon as the engine is placed in operation, the upper chamber of the exhaust gas housing 33 is filled with exhaust gas which enters through the openings 81 and 82 and through passage 74 into the exhaust gas discharge chamber 75. The pressure in the exhaust gas discharge chamber 75 quickly builds up causing the lip 97 of valve 95 to be deflected to the right as shown in FIG. 3 to permit the escape of the exhaust gas. This action is aided by the water engaging the edge of the lip 97 as the surfboard moves forward.

Any foreign objects the surfboard tends to encounter will likely be deflected by the curved wall 101 and the rods therein and are unlikely, unless they are very small, to enter the fluid intake chamber 92 and hence the impeller 66. Furthermore, if the surfboard should tip over while the impeller is still running, it is almost impossible for any of the operator's hands or other appendages to get into the path of the impeller.

If the operator should fall off of the surfboard, the throttle control will be released and the throttle will be moved to closed position.

The exhaust gas chamber 33 performs two functions. In the first place, it tends to act as a muffler. By reason of its being relatively large and by reason of the fact that the gas must pass around through the wide portion 80 of the flange of the impeller housing and through the passages 81 and 82, considerable muffling effect takes place. This is further enhanced by the fact that the exhaust gas must then pass through passage 74 and out through the gas discharge chamber 75 underneath the water. Moreover, the downwardly extending lip 97, projecting below the housing 90, tends to carry the noise into the water. The result is that the engine is extremely quiet and very little noise is sensed by the operator.

The other function of the exhaust gas chamber is to provide a gas cushion to prevent the entry of water into the exhaust system of the engine while the surfboard is standing still. It will be obvious that if the occupant is standing on the surfboard and no means are provided to prevent this, water could enter through the exhaust chamber 75 and up into the exhaust chamber 62. This is obviously undesirable for several reasons. In the first place, it would be highly undesirable for water to enter the cylinders of the engine. Even if it does not, if there is a substantial amount of water accumulated in the exhaust system, it becomes rather difficult to start the engine because starting it requires that the water be forced out of the exhaust system before the engine can actually start.

With the present arrangement, the entry of water into the exhaust chamber 62 is effectively prevented. It will be noted that the exhaust housing 33 forms a gastight chamber. The entry of water, in the first place, into the exhaust gas discharge chamber 75 is retarded by the valve 95. Any water that does seep into this chamber, however, tends to compress the remaining exhaust gas in the chamber 33 and eventually the increased pressure in the exhaust gas chamber 33 prevents the admission of water into the chamber. Thus, when it is desired to start the engine, the exhaust system of the engine will be entirely clear of water and it becomes relatively easy for the operator to start the engine.

CONCLUSION

It will be seen that the present invention provides for a power operated surfboard which is extremely quiet and can be readily manipulated by the operator. Furthermore, it is very safe. Any access to the impeller is prevented by the water intake housing. The introduction of water to the exhaust system is effectively prevented. Any water or fuel that does enter the belly pan tends to drain out of it before accumulating to any great extent. The units are arranged so that the whole power portion of the surfboard is in a very compact area leaving the major portion of the surfboard available for the occupant.

While a specific embodiment of the invention has been shown, it is to be understood that this is for purposes of illustration only and that the scope of the invention is to be limited solely by that of the appended claims.

What is claimed is:

1. A power operated surfboard with a body having a lower surface designed to move readily through the water and an upper surface which is relatively flat over the forward portion thereof to enable a rider to stand on the surfboard, the body having a floor and a raised rear hollow portion above said floor and containing an engine compartment therein, an impeller housing rigidly secured to and resting within the raised rear hollow portion of said body below said engine compartment, with a water intake passage extending through the floor of the body and a water exhaust passage extending rearwardly from the rear hollow portion, an impeller in said housing mounted for rotation about a vertical axis, an internal combustion engine disposed in said engine compartment above said impeller housing, means securing said internal combustion engine and said impeller housing in rigid relationship to each other, said engine having a vertical output shaft connected to the drive shaft of the impeller for driving the same about its vertical axis, said internal combustion engine further having a cooling jacket and an exhaust passage, an exhaust gas housing surrounding said impeller housing and having the walls thereof substantially spaced from the impeller housing to form a substantial gas chamber around said impeller housing, said exhaust gas housing being secured to said impeller housing in a substantially gastight manner, said gas chamber having an inlet opening communicating in a substantially gastight relation with the exhaust passage of the engine and having an outlet opening, and discharge means disposed adjacent the floor of the surfboard and connected to the outlet opening of the exhaust gas housing for discharging the exhaust gas rearwardly beneath the floor of the surfboard, said exhaust gas chamber acting to provide a gas cushion therein to retard the entrance of water through said discharge means into the exhaust passage of the engine when the surfboard is not being operated.

2. The surfboard of claim 1 in which the discharge means is an exhaust gas discharge housing disposed beneath the floor and having a rearwardly disposed opening for discharging the exhaust gas.

3. The surfboard of claim 2 in which valve means are associated with the rearwardly disposed opening of the exhaust gas discharge housing, said valve means being biased to closed position to retard the entrance of water into said exhaust gas housing but movable to open position as the pressure of the exhaust gas tends to rise and the surfboard moves forward.

4. The surfboard of claim 3 in which said valve means is formed of a resilient material and has a downwardly extending flap which is biased against the rearwardly disposed opening of the exhaust gas discharge housing.

5. The surfboard of claim 1 in which there is a water intake housing beneath the floor of the surfboard communicating with the water intake passage of the impeller housing, said water intake housing extending beneath the water intake passage of the impeller housing and having a forwardly directed opening for the admission of water thereto.

6. The surfboard of claim 5 in which the discharge means and the water intake housing are both part of a housing having two compartments with a partition therebetween, one of said compartments constituting the discharge means and the other the water intake housing.

7. The surfboard of claim 1 in which the water exhaust passage extends rearwardly through the rear wall of the exhaust gas housing.

8. The surfboard of claim 1 in which the means for securing said internal combustion engine and said impeller housing in rigid relationship to each other includes the exhaust gas housing which rests upon and is secured to the floor of the surfboard and supports the weight of the internal combustion engine.

9. The surfboard of claim 1 in which there is a belly pan forming the engine compartment, said belly pan being supported upon said exhaust gas housing and extending beneath and around the sides of the engine.

10. The surfboard of claim 9 in which there is a one way valve at the bottom of the belly pan, said valve acting to allow any water and fuel in said pan to drain through said valve but preventing the entrance of water into said belly pan through said valve.

11. The surfboard of claim 9 in which there is a fuel tank disposed between the front interior wall of said raised rear hollow portion and the front wall of the belly pan.

12. A power operated surfboard with a body having a lower surface designed to move readily through the water and an upper surface which is relatively flat over the forward portion thereof to enable a rider to stand on the surfboard, the body having a floor and a raised rear hollow portion above said floor and containing an engine compartment therein, an impeller housing rigidly secured to and resting within the raised rear hollow portion of said body below said engine compartment, with a water intake passage extending through the floor of the body and a water exhaust passage extending rearwardly from the rear hollow portion, an impeller in said housing mounted for rotation about a vertical axis, an internal combustion engine disposed in said engine compartment above said impeller housing, means securing said internal combustion engine and said impeller housing in rigid relationship to each other, said engine having a vertical output shaft connected to the drive shaft of the impeller for driving the same about its vertical axis, said internal combustion engine further having a cooling jacket and an exhaust passage, a gas discharge housing disposed adjacent the floor of the surfboard and connected to the exhaust passage of the engine, said gas discharge housing having a rearwardly disposed opening for discharging the exhaust gas rearwardly beneath the floor of the surfboard, and a valve means formed of a resilient material secured adjacent said rearwardly disposed opening, said valve means having a downwardly extending flap which is biased by reason of the resilience of said material against the rearwardly disposed opening of the gas discharge housing, said flap extending slightly below said gas discharge housing so that the flap is forced open during operation of said engine both by the exhaust gas pressure in said gas discharge housing and by the water pressure on the extending portion of the flap produced by forward movement of the surfboard, said flap not only acting to retard the entrance of water into said exhaust gas discharge chamber when the surfboard is not moving but also to cause the noise of the discharged exhaust gas to be carried away when the surfboard is operating.

* * * * *